US009868199B2

(12) United States Patent
Milbourne et al.

(10) Patent No.: US 9,868,199 B2
(45) Date of Patent: Jan. 16, 2018

(54) PADDLE ASSEMBLY ON A COMPACT SANDER

(71) Applicant: Black & Decker Inc., Newark, DE (US)

(72) Inventors: Rodney D. Milbourne, Abingdon, MD (US); James C. Tirone, Baltimore, MD (US); Jason F. Busschaert, Bel Air, MD (US); Oleksiy Sergyeyenko, Baldwin, MD (US); Don W. Vetter, White Marsh, MD (US); David C. Gellner, Nottingham, MD (US); Michael J. Walstrum, Abingdon, MD (US)

(73) Assignee: BLACK & DECKER INC., New Britain, CT (US)

( * ) Notice: Subject to any disclaimer, the term of this patent is extended or adjusted under 35 U.S.C. 154(b) by 684 days.

(21) Appl. No.: 14/167,125

(22) Filed: Jan. 29, 2014

(65) Prior Publication Data

US 2015/0209949 A1 Jul. 30, 2015

(51) Int. Cl.

| | |
|---|---|
| ***B25F 5/02*** | (2006.01) |
| ***B24B 23/02*** | (2006.01) |
| ***B24B 23/04*** | (2006.01) |
| ***B24B 23/00*** | (2006.01) |
| ***B24B 23/03*** | (2006.01) |

(52) U.S. Cl.

CPC ..... *B25F 5/02* (2013.01); *B24B 23/00* (2013.01); *B24B 23/02* (2013.01); *B24B 23/03* (2013.01); *B24B 23/04* (2013.01); *Y10T 29/4984* (2015.01)

(58) Field of Classification Search

CPC ..... B24B 23/02; B24B 23/03; B24B 23/04; B25F 5/02

USPC ..... 451/344, 354, 357, 359

See application file for complete search history.

(56) References Cited

U.S. PATENT DOCUMENTS 3,555,743 A * 1/1971 Geiger ..... B24B 23/046 451/357
3,847,233 A 11/1974 Glover et al.
4,071,981 A * 2/1978 Champayne ..... B24B 55/105 451/357

(Continued)

FOREIGN PATENT DOCUMENTS

EP 1308247 5/2003
TW 2177314 A2 * 4/2010 ..... B24B 23/02

OTHER PUBLICATIONS

EP Search Report for EP Application No. 15152937.7 dated Oct. 28, 2015.

*Primary Examiner* — Eileen Morgan
(74) *Attorney, Agent, or Firm* — Stephen R. Valancius

(57) ABSTRACT

A sander is provided and includes a housing, a power supply, a motor, a switch, and a switch actuation mechanism. The housing extends from a proximal end to a distal end and includes a first convex upper surface having a surface area A1. The power supply is coupled to the distal end of the housing. The motor is disposed within the housing and is powered by the power supply to drive an output member. The switch is in electrical communication with the power supply and is operable to selectively power the motor. The switch actuation mechanism is pivotably coupled to the proximal end of the housing and operable to actuate the switch. The switch actuation mechanism includes a second convex upper surface having a surface area A2.

19 Claims, 7 Drawing Sheets

(56) References Cited

U.S. PATENT DOCUMENTS 4,334,390 A 6/1982 Sumerau
4,489,524 A * 12/1984 Watson ..... B24B 23/005 451/344
4,660,329 A 4/1987 Hutchins
4,879,438 A 11/1989 Winchester
4,879,847 A 11/1989 Butzen et al.
5,022,190 A 6/1991 Hutchins
5,218,790 A * 6/1993 Huang ..... B24B 55/102 451/359
D347,561 S 6/1994 Huber et al.
5,319,888 A 6/1994 Huber et al.
5,365,155 A 11/1994 Zimmermann
D353,757 S 12/1994 Izumisawa
D353,984 S 1/1995 Izumisawa
D354,425 S 1/1995 Izumisawa
D356,017 S * 3/1995 Izumisawa ..... D8/62
5,419,737 A * 5/1995 Brazell ..... B24B 55/10 451/354
5,445,558 A 8/1995 Hutchins
5,538,040 A 7/1996 Huber et al.
5,595,530 A 1/1997 Heidelberger
5,879,228 A 3/1999 Sun
6,004,197 A 12/1999 Huber
6,007,412 A 12/1999 Hutchins
6,149,511 A 11/2000 Huber
D436,817 S 1/2001 Leu
D438,078 S 2/2001 Leu
6,190,245 B1 2/2001 Heidelberger et al.
6,257,970 B1 7/2001 Huber
6,264,408 B1 * 7/2001 Lung ..... B23B 49/008 279/157
6,328,643 B1 12/2001 Huber
6,343,982 B1 2/2002 Sun
6,394,885 B2 * 5/2002 Georgiou ..... B24B 23/005 451/344
D458,102 S 6/2002 Tseng
6,485,360 B1 11/2002 Hutchins
6,555,773 B1 4/2003 Broghammer et al.
6,610,946 B2 8/2003 Covell et al.
6,669,543 B2 12/2003 Price et al.
6,752,705 B1 * 6/2004 Lin ..... B24B 23/026 451/295
6,793,568 B2 9/2004 Dotta
6,794,593 B2 9/2004 Kraenzler et al.
6,855,040 B2 2/2005 Huber
D504,602 S 5/2005 Aglassinger et al.
6,928,902 B1 * 8/2005 Eyssallenne ..... B25B 21/00 81/57.26
D509,417 S 9/2005 Wikle et al.
6,974,370 B2 12/2005 Hutchins
6,979,254 B1 12/2005 Huber
7,044,235 B2 * 5/2006 Lin ..... B24B 23/026 173/169
D527,594 S 9/2006 Wikle
D527,595 S 9/2006 Wikle
D527,965 S 9/2006 Aglassinger
7,118,467 B2 * 10/2006 Sun ..... B24B 23/02 451/344
D538,122 S 3/2007 Etter et al.
7,189,154 B1 * 3/2007 Karppinen ..... B24B 57/02 451/357
7,222,679 B1 5/2007 Dohogne
7,270,591 B2 9/2007 Deshpande et al.
7,318,768 B2 1/2008 Deshpande et al.
D566,503 S 4/2008 Leasure
7,371,150 B2 5/2008 Deshpande et al.
7,411,144 B2 8/2008 Broghammer
7,476,821 B1 1/2009 Knuppel
7,485,026 B2 2/2009 King
7,497,152 B2 3/2009 Zeiler et al.
7,662,027 B2 2/2010 Hutchins
7,699,687 B2 4/2010 Nordstrom
7,722,435 B2 * 5/2010 King ..... B24B 23/00 451/354
7,791,232 B2 9/2010 Purohit et al.
7,989,718 B1 8/2011 Weber
7,997,959 B2 8/2011 Hutchins et al.
8,057,285 B2 * 11/2011 Lampka ..... B24B 23/005 16/426
8,087,976 B2 1/2012 Gallagher et al.
8,100,747 B2 1/2012 Singer et al.
8,382,559 B2 2/2013 Chen
2003/0143935 A1 * 7/2003 Huber ..... B24B 23/03 451/357
2003/0228833 A1 12/2003 Boyer
2005/0020196 A1 * 1/2005 Chen ..... B24B 23/03 451/359
2006/0060365 A1 3/2006 Kunz
2007/0287365 A1 12/2007 Deshpande et al.
2008/0045127 A1 * 2/2008 Lampka ..... B24B 23/005 451/357
2009/0104861 A1 4/2009 Van Der Linde et al.
2010/0099341 A1 * 4/2010 Huber ..... B24B 23/02 451/357
2010/0105287 A1 * 4/2010 Nordstrom ..... B24B 23/00 451/1
2010/0300641 A1 12/2010 Purohit et al.
2012/0302143 A1 * 11/2012 Nordstrom ..... B24B 23/005 451/344
2013/0023189 A1 1/2013 Numata

* cited by examiner

PADDLE ASSEMBLY ON A COMPACT SANDER

FIELD

The present disclosure relates to an improved paddle switch assembly for a power tool, and more particularly to an improved paddle switch assembly for a power sander.

BACKGROUND

Electric power tools, such as sanding tools, often utilize electrical switches and switch actuation mechanisms to control the flow of electrical power to the tool. Proper design and placement of the switch and the switch actuation mechanism on an electric power tool, such as a power sander, can improve the design and operation of the sander. For example, if the switch actuation mechanism does not clearly indicate whether the switch is in an "ON" or "OFF" position, then the sander may inadvertently begin operating when the sander is connected to a power source. In addition, if the switch actuation mechanism is difficult to actuate, then power to the sander may be inadvertently disrupted while operating the sander.

In order to improve the performance of power sanding tools and other electric power tools, it may be desirable to have an improved switch assembly, including an improved switch actuation mechanism.

This section provides background information related to the present disclosure which is not necessarily prior art.

SUMMARY

This section provides a general summary of the disclosure, and is not a comprehensive disclosure of its full scope or all of its features.

According to one particular aspect, the present disclosure provides a sander. The sander includes a housing, a power supply, a motor, a switch, and a switch actuation mechanism. The housing extends from a proximal end to a distal end and includes a first convex upper surface having a surface area A1. The power supply is coupled to the distal end of the housing. The motor is disposed within the housing and is powered by the power supply to drive an output member. The switch is in electrical communication with the power supply and is operable to selectively power the motor. The switch actuation mechanism is pivotably coupled to the proximal end of the housing and operable to actuate the switch. The switch actuation mechanism includes a second convex upper surface having a surface area A2.

According to another particular aspect, the present disclosure provides a sander. The sander includes a housing, a power supply, a motor, a switch, and a switch actuation mechanism. The housing includes a first convex upper surface having a surface area A1. The power supply is coupled to the housing. The motor is disposed within the housing and is powered by the power supply to drive an output member. The switch is in electrical communication with the power supply and is operable to selectively power the motor. The switch actuation mechanism is pivotably coupled to the housing and is operable to actuate the switch. The switch actuation mechanism includes a second convex upper surface having a surface area A2. The surface area A2 may be at least sixty-five percent of the surface area A1.

According to yet another particular aspect, the present disclosure provides a method of assembling a power sander. The method includes providing a motor and assembling a housing to substantially surround the motor. The housing includes a first clam shell mounted to a second clam shell. The first and second clam shells include a first convex upper surface having a surface area A1. The method also includes pivotably mounting a switch actuation mechanism to the housing. The switch actuation mechanism includes a second convex upper surface substantially surrounding the first convex upper surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
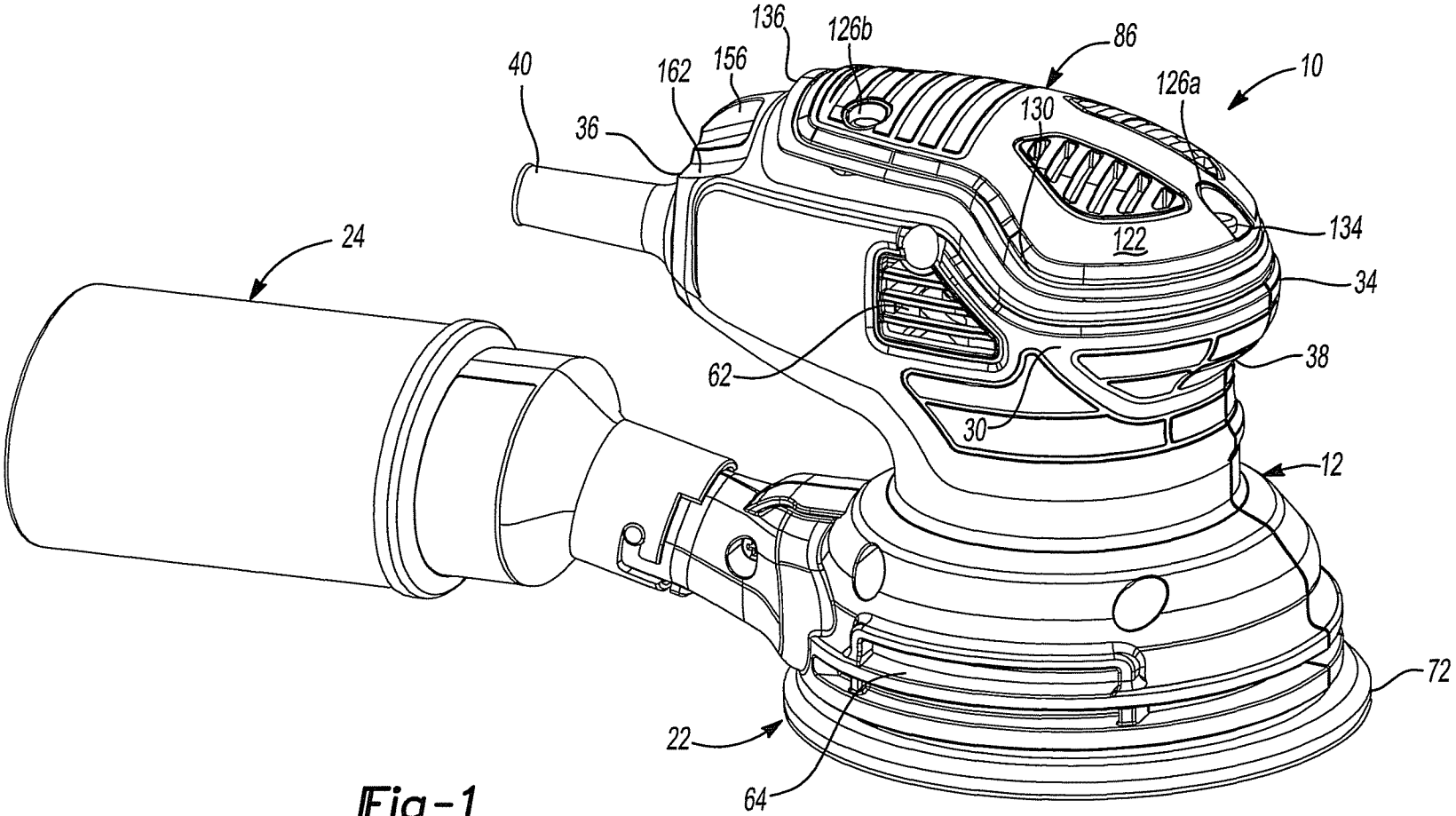
FIG. 1 is a perspective view of a power tool including a switch system in accordance with the principles of the present disclosure.

With reference to FIG. 1, a power tool in accordance with the present disclosure is illustrated and designated with the reference numeral 10. The power tool 10 will be described in the context of an electric-powered sander and will be referred to as sander 10.

Figure 2:
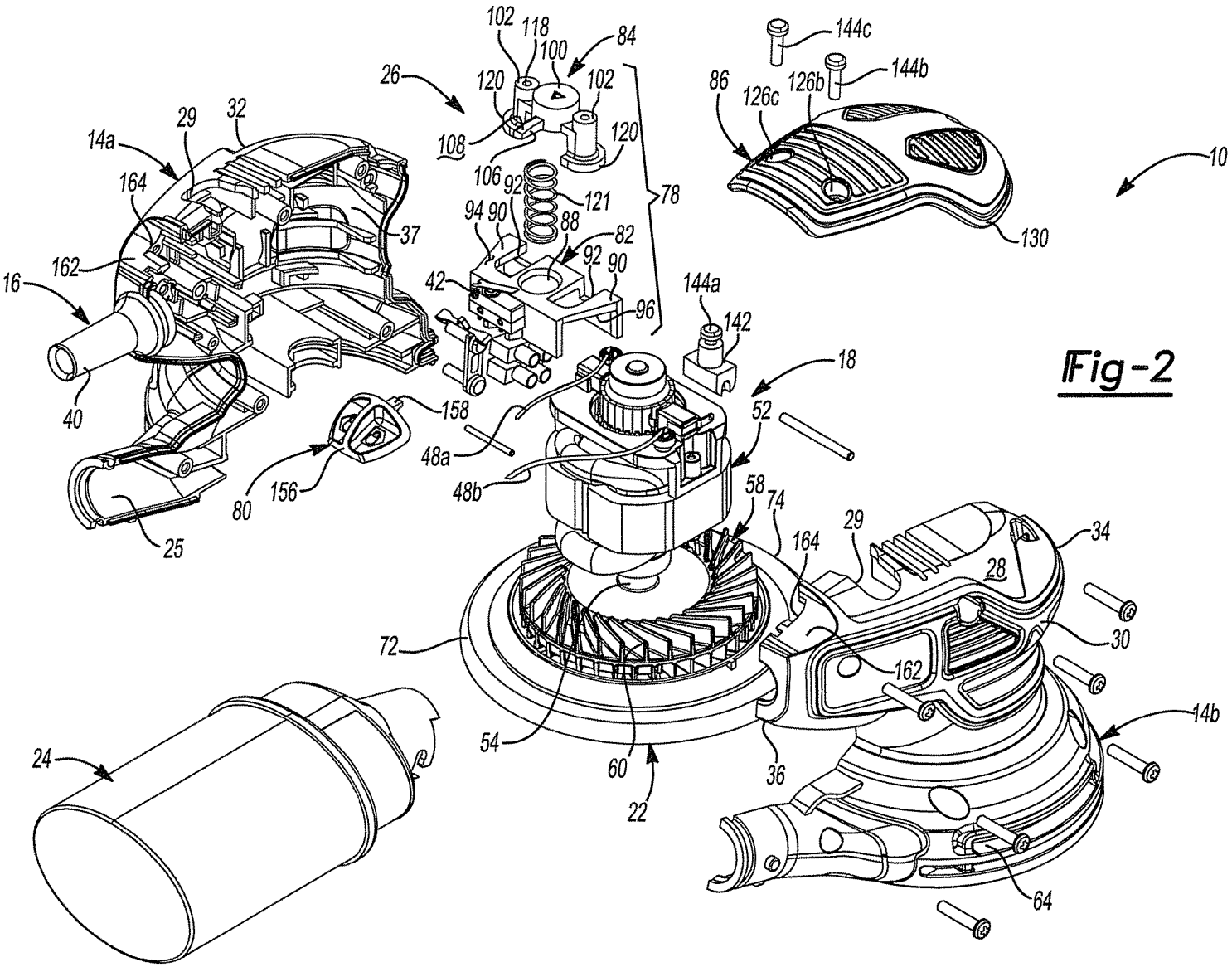
FIG. 2 is a partially exploded view of the power tool of FIG. 1.

As illustrated in at least FIG. 1 or 2, the sander 10 includes a tool body or housing 12 having a pair of clam shell portions 14*a*, 14*b*, a power system 16, a drive system 18, a sanding platen 22, a dust collection unit or chamber 24 to which dust can be extracted from air that is drawn through a dust extraction port 25 formed in the housing 12, and a switch system 26. In the example embodiment, the sanding platen 22 is driven by the drive system 18. The dust collection chamber 24 may further include a filter (not shown) for removing dust and other debris from the air. In one embodiment, the dust collection chamber 24 may be removed from the dust extraction port and replaced with a vacuum hose to collect the dust. The vacuum hose may connect directly to the dust extraction port or, alternatively, an adapter may be used to accommodate the vacuum hose if it is a different size or shape than the dust extraction port. For example, if the dust extraction port is oblong, an adapter may have an oblong end to connect to the dust extraction port and a circular shaped end for connecting to a vacuum hose so that the vacuum hose can work with the dust extraction port even if they are not the same shape or size.

Figure 3:
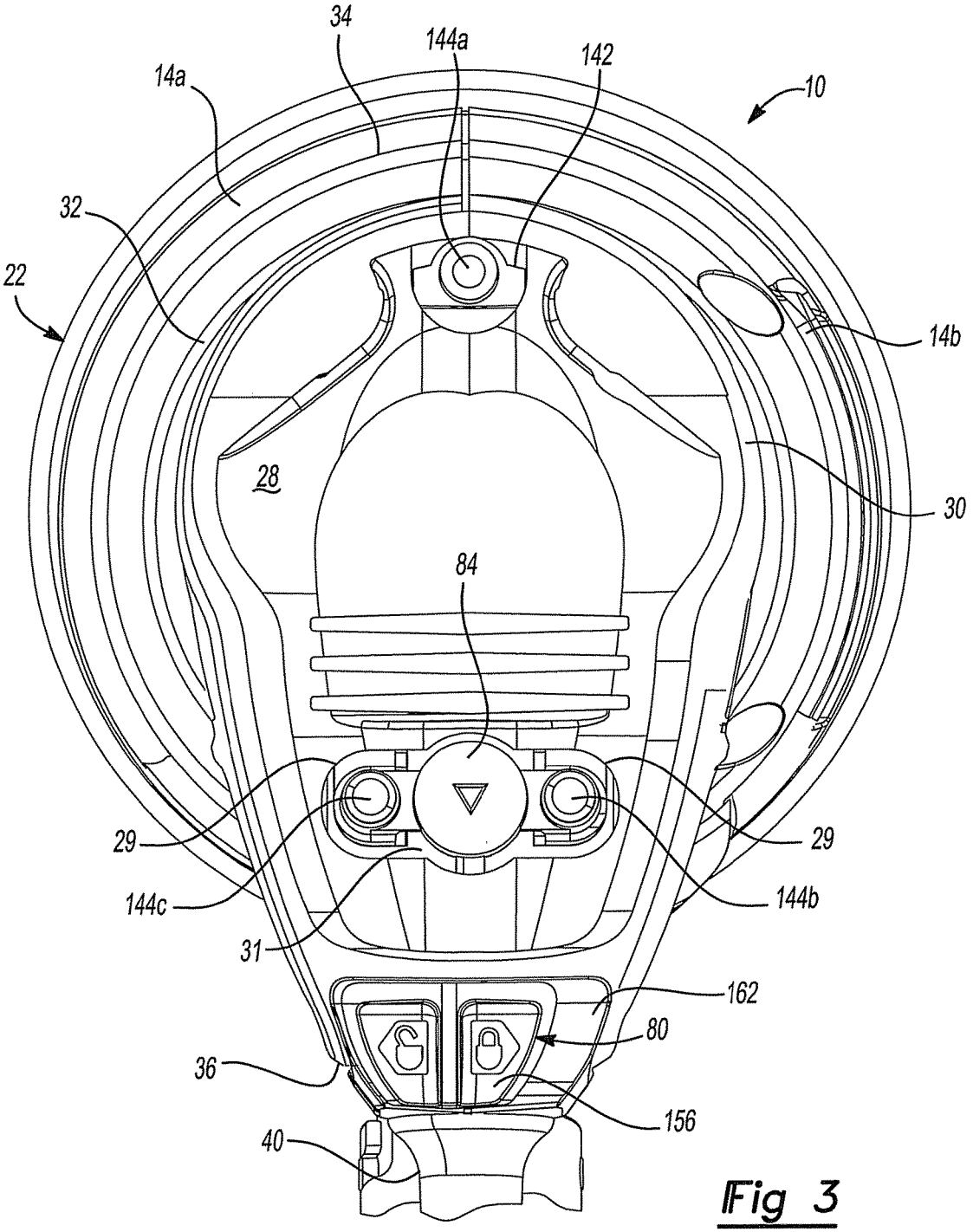
FIG. 3 is a top view of the power tool of FIG. 1, illustrated with a portion of the switch system removed.
Figure 4:
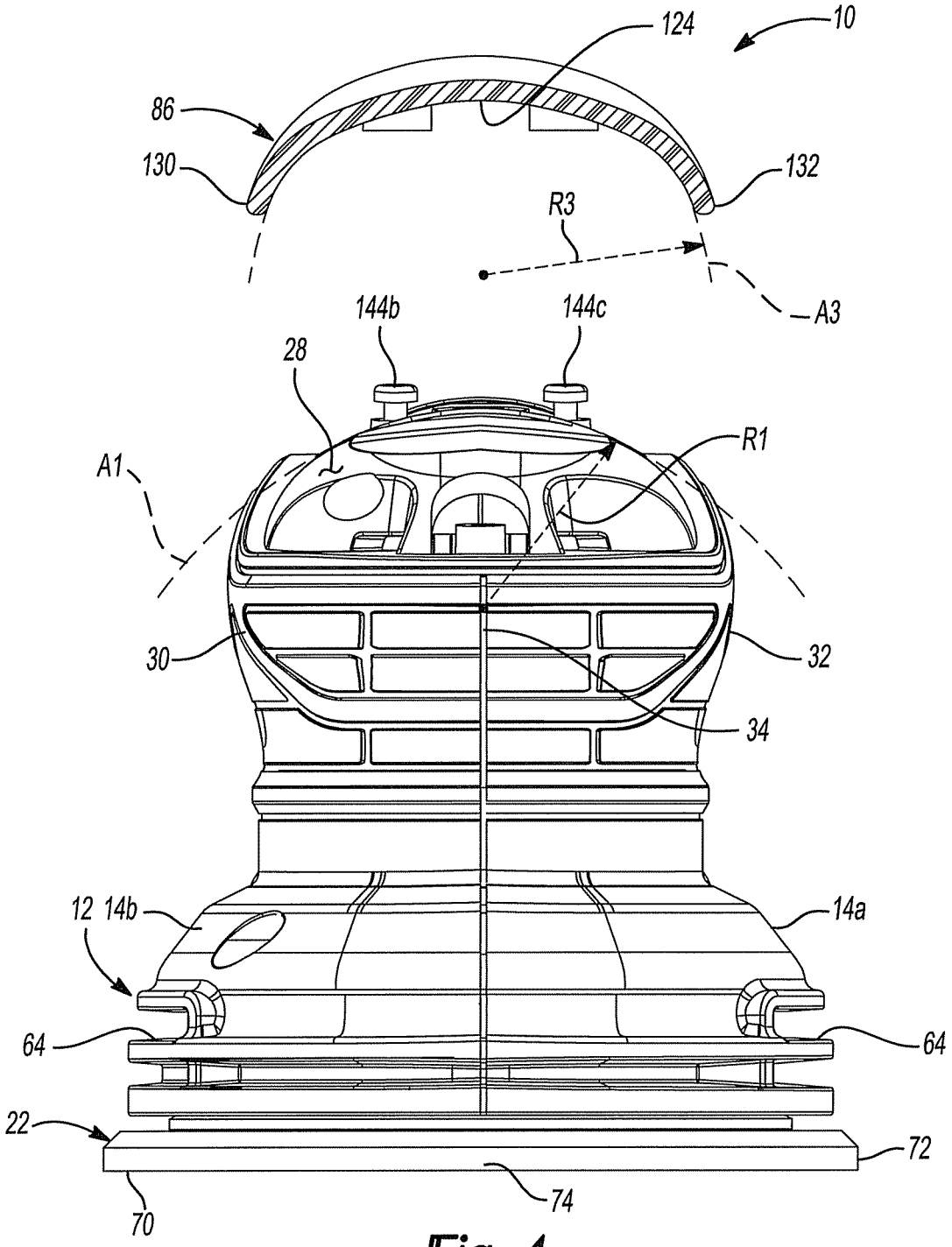
FIG. 4 is a front view of the power tool of FIG. 1, illustrated with a portion of the switch system exploded from the power tool.
Figure 5:
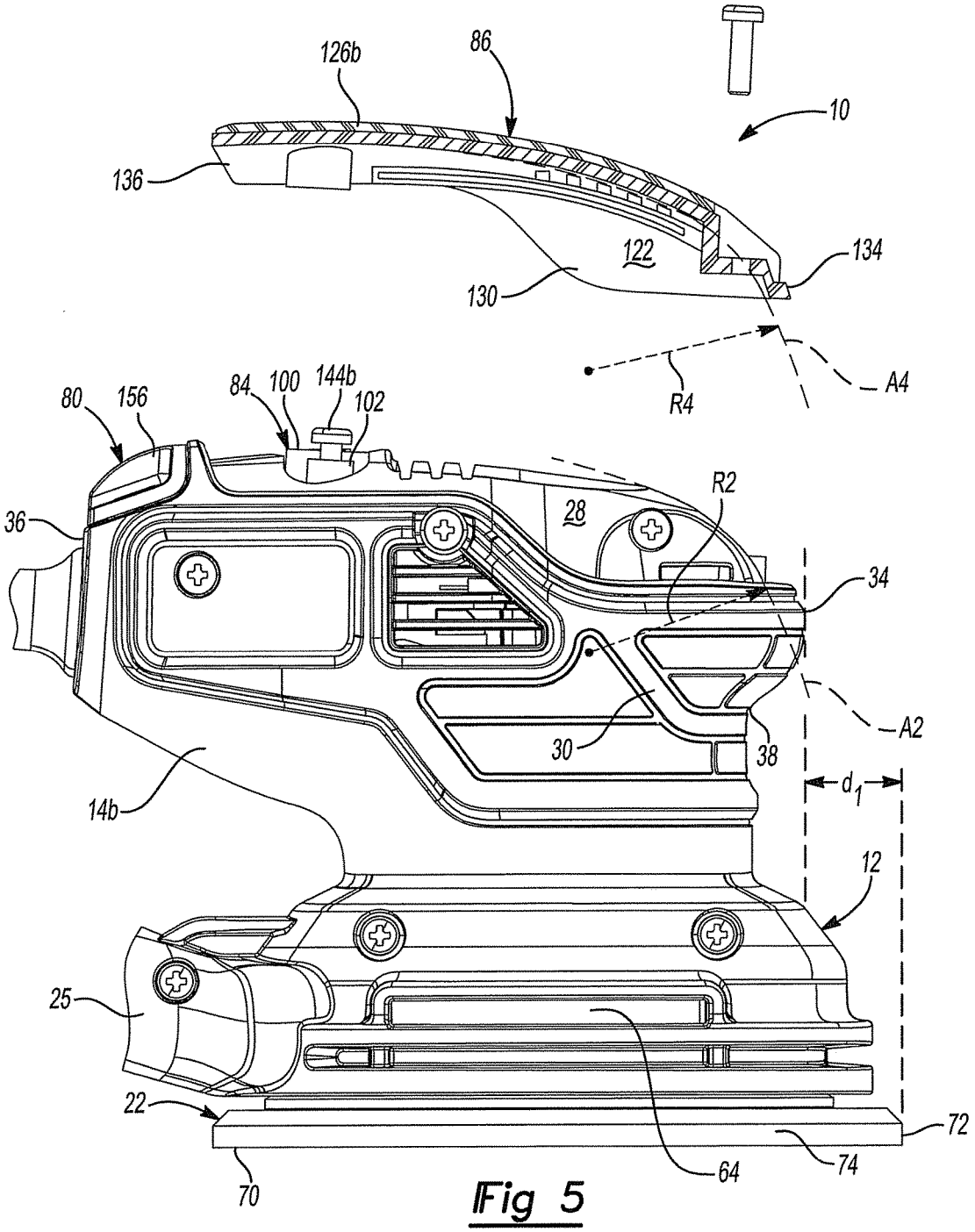
FIG. 5 is a side view of the power tool of FIG. 1, illustrated with a portion of the switch system exploded from the power tool.

With reference to FIG. 3, the clam shell portions 14*a*, 14*b* each include an arcuate or curved upper surface, collectively defining an upper surface 28 of the housing 12, and a cutout or notch 29. The upper surface 28 is substantially convex. As illustrated in FIG. 4, the surface 28 may define a first arc A1 extending from and between a first lateral side 30 of the housing 12 and a second lateral side 32 of the housing 12. As illustrated in FIG. 5, the surface 28 may also define a second arc A2 extending between a forward or proximal end 34 of the housing 12 and a rearward or distal end 36 of the housing 12. In the example embodiment, the first and second arcs A1, A2 are concave relative to a cavity 37 defined by the clam shell portions 14*a* and 14*b*. In this regard, the first and second arcs A1, A2 may subtend a central angle of at least five degrees. The first arc A1 includes a first radius of curvature R1 and the second arc A2 includes a second radius of curvature R2. In the example embodiment, the second radius of curvature R2 is greater than the first radius of curvature R1. As illustrated in FIG. 3, in an assembled configuration, the notch 29 of the clam shell portion 14*a* is aligned with the notch of the clam shell portion 14*b* such that the notches 29 define an aperture 31 through the upper surface 28 of the housing 12.

Figure 6:
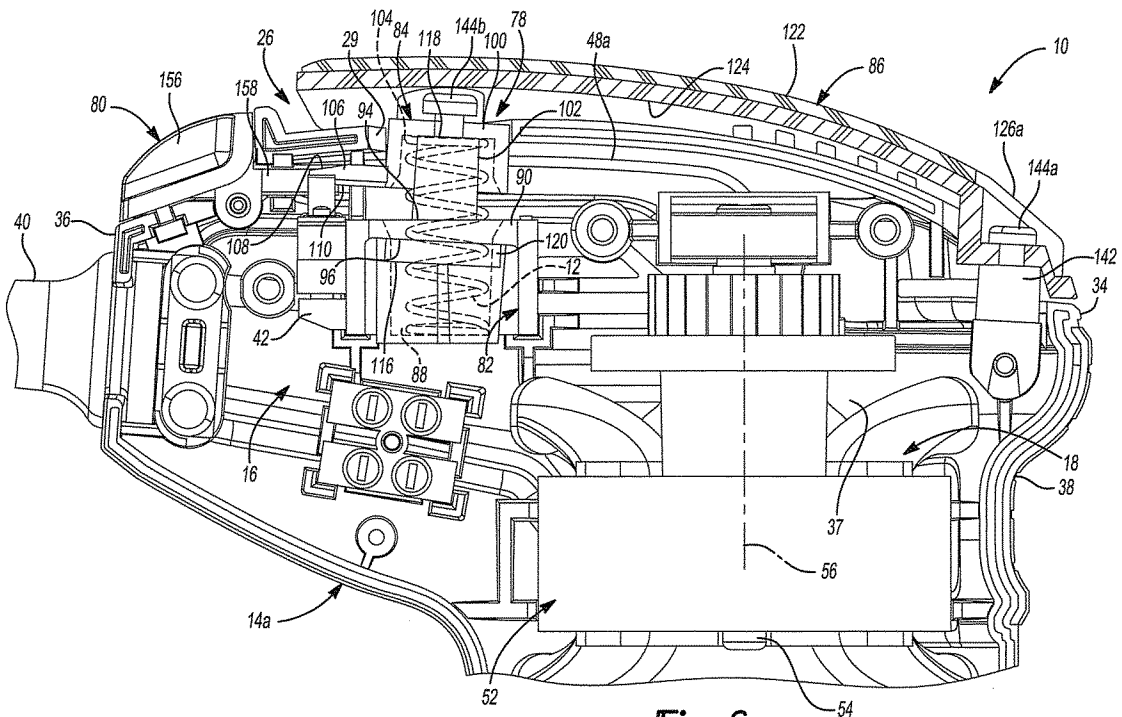
FIG. 6 is a side view of the power tool of FIG. 1 shown partially in section, the switch system shown in a first configuration.
Figure 7:
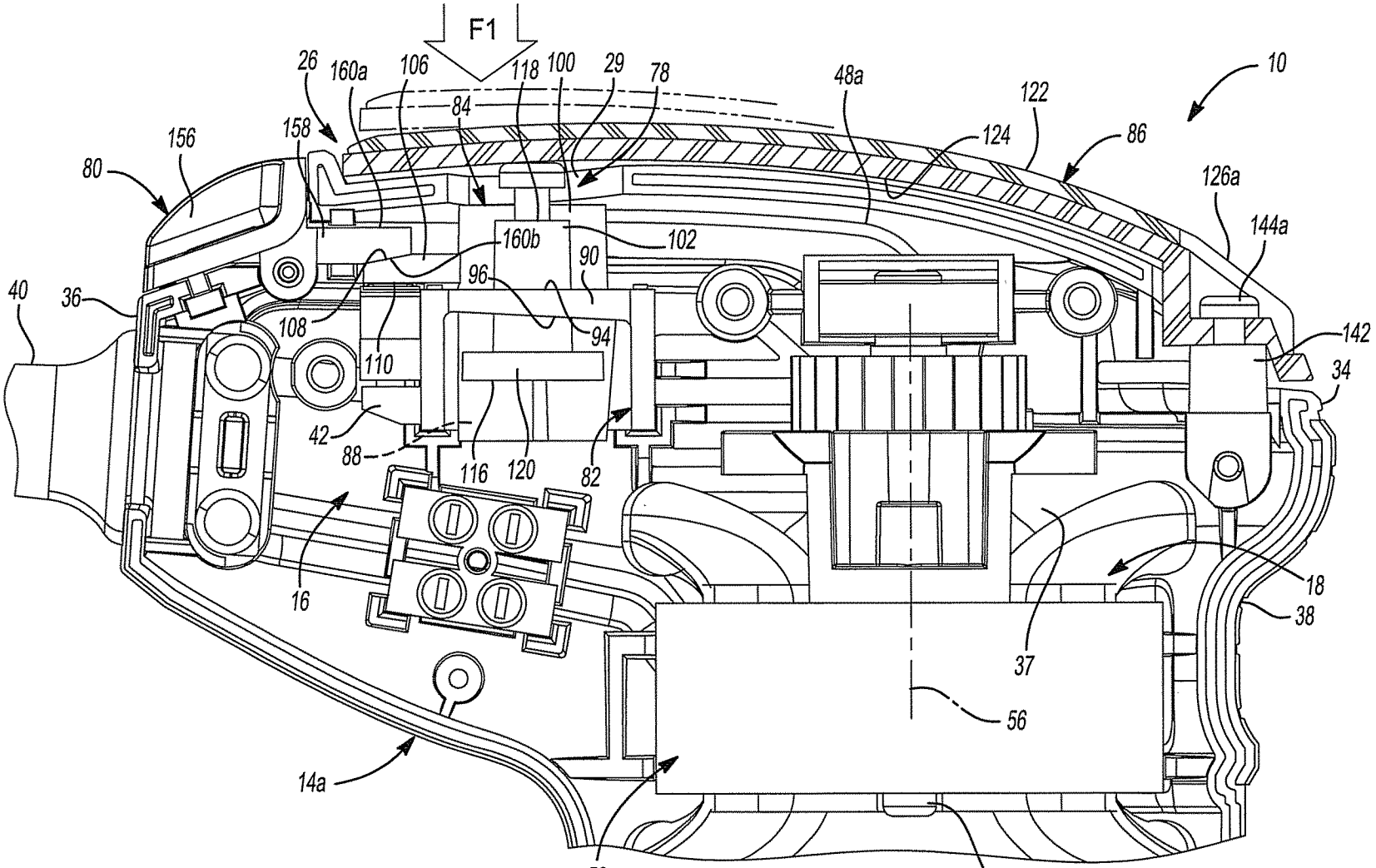
FIG. 7 is a side view of the power tool of FIG. 1 shown partially in section, the switch system shown in a second configuration.

As illustrated in FIGS. 5 through 7, the clam shell portions 14*a*, 14*b* can also include a recessed portion or channel 38. The channel 38 can be disposed or otherwise formed between the upper surface 28 and the sanding platen 22. In the example embodiment, the channel 38 extends generally horizontally around the proximal end 34 of the housing 12, from and between the first lateral side 30 of the housing 12 and the second lateral side 32 of the housing 12. The channel 38 can provide a location for the user's fingers that is recessed relative to an outermost surface of the housing 12, to help the user grip the housing while operating the sander 10. The user's palm is then positioned over the paddle 68 so as to be in a position to activate the sander.

With particular reference to FIG. 2, the power system 16 can include a power cord 40 and a switch 42. The power cord 40 can include a first lead 48*a* and a second lead 48*b*. The first lead 48*a* is in communication with the switch 42. In the example embodiment, the power cord 40 is coupled to the clam shell portion 14*a* of the housing 12 and the switch 42 is coupled to a portion of the switch system 26. It will be appreciated that while the sander 10 is shown operatively associated with a power cord 40 for alternating current (AC) operation, the sander 10 can also be configured for operation with other power sources, such as direct current (DC) or a pneumatic input.

The drive system 18 is housed in the cavity 37 and can include an electric motor 52 mounted within the housing 12 and having an output shaft 54 for rotation about an axis 56. In the example embodiment, the motor 52 is mounted between the switch 42 and the proximal end 34 of the housing. As illustrated in FIG. 2, a fan 58 can be mounted on the output shaft 54 for rotation therewith. The fan 58 can include a plurality of upwardly projecting blades 60. The blades 60 can be generally arranged to draw air in from at least one opening 62 in the housing and/or from an opening 64 between the housing 12 and the sanding platen 22, and direct the air toward the motor 52. In this manner, the upwardly projecting fan blades 60 can operate to generate a cooling airflow when the motor 52 is turned on to help cool the motor 52 during operation of the sander 10. A bearing (not shown) can be eccentrically located radially with respect to the output shaft 54. The sanding platen 22 can be operably secured to the output shaft 54. In the example embodiment, the output shaft 54 and the axis 56 extend substantially perpendicularly from the sanding platen 22. It will also be appreciated that the output shaft 54 and the axis 56 may extend from the sanding platen 22 at various angles and directions. The bearing can cause an orbital movement of the sanding platen 22 in response to driving rotation of the output shaft 54. It is appreciated that while the particular example described is an orbital sander, the present teachings may be similarly applied to other sander tools such as random orbital sanders and belt sanders for example.

The sanding platen 22 can be formed in any desired manner. In the particular example provided, the sanding platen 22 has a substantially flat bottom surface 70 and an arcuate peripheral edge 72 that provides the sanding platen 22 with a substantially circular shape. In other embodiments, the sanding platen may include other shapes such as a triangle, rectangle or other polygon. An abrasive sheet (not shown) can be applied to the flat bottom surface by way of a hook and loop fabric fastener (e.g., Velcro®), or clips (e.g., wire form clips), adhesive, or any other suitable fastening system. For example, an underside of the abrasive sheet can have a first Velcro surface which can be attachable to a second Velcro surface (not shown) provided on the flat bottom surface 70 of the sanding platen 22.

With reference to FIG. 5, in the example embodiment, a front or forward edge 74 of the platen 22 extends in the forward direction a distance ($d_1$) beyond the proximal end 34 of the housing 12. That is, the proximal end 34 of the housing 12 may be offset from the forward edge 74 of the platen 22 in a generally horizontal direction by the distance ($d_1$). The distance ($d_1$) can be between twenty millimeters and fifty millimeters. In the example embodiment, the distance ($d_1$) is on the order of thirty (30) millimeters. The offset between the forward edge 74 of the platen 22 and the proximal end 34 of the housing 12 will allow the user to place the forward edge 74 of the platen 22 adjacent to a vertical wall or other obstruction (not shown) and grasp the sander 10, including the upper surface 72 of the housing 12, without the user's hand contacting the obstruction.

As illustrated in FIG. 2, the switch system 26 includes a switch actuation assembly 78 and a switch lock mechanism 80, and is operable to actuate the switch 42 in order to control the transmission of power from the power system 16 to the drive system 18. In the example embodiment, the switch actuation assembly 78 includes a housing 82, a linkage assembly 84, and a switch actuation mechanism or paddle 86. The housing 82 can be mounted to one or both of the clam shell portions 14*a*, 14*b* and can include a central, longitudinally extending first chamber or cavity 88 and at least one laterally extending stop plate 90. In the example embodiment, the housing 82 includes two stop plates 90 disposed on opposite sides of the first cavity 88. The stop plate 90 defines a slot 92, an upper surface 94 and a lower surface 96.

The linkage assembly 84 can be mounted to the housing 82 of the switch actuation assembly 78. The linkage assembly 84 can include a control portion 100 and at least one laterally extending mount portion 102. In the example embodiment, the linkage assembly 84 includes two mount portions 102 disposed on opposite sides of the control portion 100. The control portion 100 can include a longitudinally extending second chamber or cavity 104 and a switch actuation portion 106. The switch actuation portion 106 extends laterally from the second cavity 104 and defines an upper surface 108 and a lower surface 110. The upper surface 108 may be chamfered or tapered. The lower surface 110 of the switch actuation portion 106 may be operable to actuate the switch 42 to provide power to the drive system 18. The mount portion 102 includes extends longitudinally between a first end 116 and a second end 118. The first end 116 includes a flange 120. In the example embodiment, the flange 120 extends annularly from an outer peripheral surface of the mount portion 102.

As illustrated in FIGS. 2 and 5, in an assembled configuration, the mount portion 102 of the linkage assembly 84 is received by the slot 92 of the stop plate 90 such that the first cavity 88 of the housing 82 is longitudinally aligned with the second cavity 104 of the linkage assembly 84, and the switch actuation portion 106 is longitudinally aligned with the switch 42. A biasing member 121, such as a helical spring, can be disposed within at least one of the first and second cavities 88, 104 to generally bias the linkage assembly 84 in an upward longitudinal direction (relative to the view in FIG. 5), and generally away from the housing 82. As will be explained in more detail below, in the assembled configuration, the flange 120 of the mount portion 102 and the lower surface 96 of the stop plate 90 can limit the movement of the linkage assembly 84 relative to the housing 82 in the upward longitudinal direction.

With reference to at least FIGS. 1, 4 and 5, the switch actuation paddle 86 is located at the top of the housing 12 (relative to the views in FIGS. 1, 4 and 5), and above the motor 52, such that the motor is located between the sanding platen 22 and the switch actuation paddle 86. The switch actuation paddle 86 includes an arcuate or curved upper surface 122, an arcuate or curved lower surface 124, a first mount portion 126*a*, a second mount portion 126*b*, and a third mount portion 126*c*. In the example embodiment, the upper surface 122 is convex, while the lower surface 124 is concave, such that the paddle 86 is a substantially dome or shell-shaped member. The upper and lower surfaces 122, 124 may be similarly sized and shaped as the upper surface 28 of the housing 12. In this regard, the upper and/or lower surfaces 122, 124 can be sized such that the paddle 86, including a surface area S1 of the upper surface 122, covers more than sixty-five percent of a surface area S2 of the upper surface 28 of the housing 12. In the example embodiment, the paddle 86 covers at least seventy-five percent of the surface area S2, and preferably seventy-nine percent of the surface area S2. The configuration of the paddle 86, including the convex upper surface 122, can provide a more ergonomic grip or handle, and help the user to better maneuver the sander 10 over a workpiece (not shown). Additionally, the lower surface 124 can wrap around the upper surface 28 of the housing so that the paddle 68 generally matches the contour of the sander housing 12. The size of the paddle 86, including the size of the surface area S1 relative to a size of the surface area S2, can also help to ensure that the switch mechanism 26 activates the switch 42 at all desirable times during operation of the sander 10. In other words, the size of the paddle 86 relative to the surface area S2 of the housing 12 can help to ensure that the user's hand does not inadvertently deactivate the switch mechanism 26, and thus the switch 42, during operation of the sander 10. Additionally, the user may grasp the sander 10 in any of a number of different positions and still rest a portion of their palm on the paddle 86 so as to be able to activate the sander 10.

With reference to FIG. 4, the lower surface 124 may define a third arc A3 extending between a first lateral side 130 of the paddle 86 and a second lateral side 132 of the paddle 86. As shown in, for example, FIGS. 2 and 4, the paddle 68 has a rear portion near the distal end 136 which is substantially rectangularly shaped and a widened portion near a proximal end 134 that extends from the first lateral side 130 to the second lateral side 132. With reference to FIG. 5, the lower surface 124 may also define a fourth arc A4 extending between a proximal end 134 of the paddle 86 and a distal end 136 of the paddle 86. The third arc A3 includes a third radius of curvature R3 that is substantially equal to, or slightly greater than, the first radius of curvature R1 of first arc A1. The fourth arc A4 includes a fourth radius of curvature R4 that is substantially equal to, or slightly greater than, the second radius of curvature R2. Accordingly, a profile of the lower surface 124 of the paddle 86 is similar to a profile of the upper surface 28 of the housing 12. The upper surface 122 of the paddle 86 may also include a series or pattern of ridges 138 that allow a user to securely grasp the paddle 86 to improve the maneuverability of the sander 10 over the workpiece.

The first mount portion 126*a* can be located near the proximal end 134 of the paddle 86 and can be pivotably coupled to the forward end 34 of the housing 12. In this regard, the forward end 34 of the housing 12 may include a hinge member 142. The first mount portion 126*a* may be coupled to the hinge member 142 by a screw 144*a* or other suitable fastening device, such as a bolt, clip, or rivet. The second and third mount portions 126*b*, 126*c* can be located near the distal end 136 of the paddle 86, such that the second and third mount portions 126*b*, 126*c* are substantially aligned with the aperture 31 in the housing 12 and with the mount portions 102 of the linkage assembly 84. The second mount portion 126*b* may be coupled to the second end 118 of one of the mount portions 102 and the third mount portion 126*c* may be coupled to the second end 118 of the other of the mount portion 102. The second and third mount portions 126*b*, 126*c* may be coupled to the mount portions 102 by a screw 144*b*, 144*c*, respectively, or other suitable fastening device, such as a bolt, clip, or rivet. The first, second and third mount portions 126*a*-126*c* may be recessed relative to the upper surface 122 of the paddle 86, such that the screws 144*a*-144*c* are located, or otherwise positioned, below the upper surface 122 of the paddle 86 as the paddle pivots about the first mount portion 126*a*.

The configuration of the first mount portion 126*a* relative to the housing 12, including the pivotable configuration of the first mount portion 126*a* relative to the forward end 34 of the housing 12, helps to ensure that the switch 42 can be located near the rearward or distal end 36 of the housing 12. Locating the switch 42 near the rearward or distal end 36 of the housing 12 helps to ensure that the power cord 40, including the first and second leads 48*a*, 48*b*, do not cross or otherwise traverse the drive system 18 in order to reach the proximal end 34 of the housing 12. This configuration can help to ensure that the sander 10 is smaller, lighter and/or easier to maneuver and operate over the workpiece.

As shown in at least FIG. 2, the switch lock mechanism 80 may be mounted near the rearward or distal end 36 of the housing 12 and may include a control portion 156 and a beam portion 158. The beam portion 158 may be integrally formed with, and extend from, the control portion 156, and may include an upper surface 160*a* and a lower surface 160*b*. The lower surface 160*b* may be chamfered or tapered. In the assembled configuration, the control portion 156 may be slidingly received by a recessed portion 162 of the housing 12 and the beam portion 158 may extend through, and be slidingly received by an aperture 164 in the housing 12. In this regard, the switch lock mechanism 80 may be generally operable to slide from a first, or unlocked position on the first lateral side 30 of the housing 12 (FIG. 6) to a second, or locked position on the second lateral side 32 of the housing 12 (FIG. 7). In the first position, the beam portion 158 may be located generally adjacent to the switch actuation portion 106 of the linkage assembly 84. In one configuration of the second position, the upper surface 160*a* of the beam portion 158 may be located adjacent to the lower surface 110 of the switch actuation portion 106 in order to lock the switch actuation paddle 86 in an "OFF" position (i.e., preventing downward motion and/or counterclockwise rotation of the switch actuation paddle 86, relative to the view in FIG. 7). As will be explained in more detail below, in another configuration of the second position (FIG. 7), the beam portion 158 may be located generally above the switch actuation portion 106 of the linkage assembly 84 such that the lower surface 160 of the beam portion 158 contacts the upper surface 108 of the switch actuation portion 106 to lock the switch actuation paddle 86 in an "ON" position (i.e., preventing upward motion and/or clockwise rotation of the switch actuation paddle 86, relative to the view in FIG. 7).

To operate the switch system 26, and thereby provide power to the drive system 18, the user may slide or otherwise move the switch lock mechanism 80 from the second or locked position to the first or unlocked position, thereby allowing the user to press the switch actuation paddle 86, such that the switch actuation paddle 86 pivots about the proximal end 134 thereof (e.g., the first mount portion 126*a*). As the paddle 86 pivots about the proximal end 134, the distal end 136 of the paddle 86 (e.g., the second and third mount portions 126*b*, 126*c*) can apply a force F1 on the linkage assembly 84 that overcomes an opposite force F2 of the biasing member 121, and thus causes the linkage assembly 84 (e.g., the switch actuation portion 106) to contact the switch 42, moving the switch 42 from the "OFF" position to the "ON" position. Because the paddle 86 is hinged at the proximal end 134, the palm of the user's hand is generally located near the biasing member 121 so as to easily apply the force F1. However, given the size and construction of the paddle 68, a user's hand and palm can be placed in a variety of different positions and still activate the switch 42. Activation of the switch 42 will send electrical current from the power system 16 to the drive system 18 to power the sander 10. With the switch 42 in the ON position, the user can slide the switch lock mechanism 80 to the locked position, such that the beam portion 158 applies a force F3 on the switch actuation portion 106 of the linkage assembly 84. The force F3 opposes the force F2 of the biasing member 121, and thus prevents the biasing member 121 from biasing the linkage assembly 84 away from the switch 42. Accordingly, the switch lock mechanism 80 is operable to secure the switch 42 in the "ON" position.

To assemble the sander 10, the clam shell portions 14*a*, 14*b* can be assembled to define the arcuate upper surface 28 of the housing 12. With the clam shell portions 14*a*, 14*b* assembled, the paddle 86 can then be coupled to the housing 12 to cover the upper surface 28, which is defined by both the clam shell portions 14*a*, 14*b*. For example, the first mount portion 126*a* of the paddle 86 can be coupled to the hinge member 142, and the second and third mount portion 126*b*, 126*c* can be coupled to the linkage assembly 84 (e.g., the second end 118 of the mount portion 102).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A sander comprising:

a housing having a first end and a second end opposite the first end, the housing also including a first convex upper surface;

a power supply coupled to the first end of the housing;

a motor disposed within the housing, the motor powered by the power supply and operable to drive an output member;

a switch in electrical communication with the power supply and operable to selectively power the motor; and a switch actuation mechanism pivotably coupled to the second end of the housing via a hinge member and operable to actuate the switch, the switch actuation mechanism including a second convex upper surface;

wherein the switch actuation mechanism is pivotably coupled to the second end of the housing at a location forward of the motor;

wherein the switch actuation mechanism extends rearward of the motor, wherein the first end of the housing defines the rear of the sander and the second end of the housing defines the front of the sander; and wherein, when the sander is placed on a flat horizontal surface, the motor is located entirely between the switch and the hinge member.

2. The sander of claim 1, wherein the output member is a sanding platen.

3. The sander of claim 1, further comprising a switch lock mechanism operable to secure the switch actuation mechanism in an actuated position.

4. The sander of claim 1, further comprising a linkage assembly biasingly engaging the switch actuation mechanism, wherein the linkage assembly is operable to directly actuate the switch.

5. The sander of claim 4, further comprising a switch lock mechanism operable to secure the linkage assembly in an actuated position relative to the switch.

6. The sander of claim 1, wherein the switch is disposed closer to the first end of the housing than the second end of the housing.

7. The sanders of claim 6, wherein the motor is located between the first end and the second end of the housing.

8. The sander of claim 1, wherein the switch actuation mechanism further includes a concave lower surface disposed adjacent to the first convex upper surface.

9. The sander of claim 1, wherein the switch is located rearwardly of the motor.

10. The sander of claim 1, wherein the housing includes a first side and a second side opposite the first side, a line from the first side to the second side being perpendicular to a line from the first end to the second end;

wherein the switch actuation mechanism has a switch actuation mechanism lower surface;

wherein the switch actuation mechanism lower surface is convex along a direction from the first side to the second side.

11. A sander comprising:

a housing including a first convex upper surface;

a power supply coupled to the housing;

a motor disposed within the housing, the motor powered by the power supply and operable to drive an output member;

a switch in electrical communication with the power supply and operable to selectively power the motor; and a switch actuation mechanism pivotably coupled to the housing and operable to actuate the switch, the switch actuation mechanism including a second convex upper surface;

wherein the output member is a sanding platen;

wherein the housing expends from a proximal end to a distal end, and wherein the switch is disposed in the distal end of the housing and the switch actuation mechanism is pivotably coupled to a hinge member disposed in the proximal end of the housing; and wherein, when the sander is placed on a flat horizontal surface, the motor is located entirely between the switch and the hinge member.

12. The sander of claim 11, further comprising a switch lock mechanism operable to secure the switch and the switch actuation mechanism in an actuated position.

13. The sander of claim 12, further comprising a linkage assembly biasingly engaging the switch actuation mechanism, wherein the linkage assembly is operable to directly actuate the switch.

14. The sander of claim 11, wherein the switch actuation mechanism is a paddle.

15. The sander of claim 14, wherein the paddle has a lower surface; and wherein the lower surface is convex along a first direction and a second direction, the first direction being perpendicular to the second direction.

16. The sander of claim 14, wherein the sander housing comprises a rear, where the power source is coupled to the housing, and a front, which is opposite the rear;

wherein, when the sander is placed on a flat horizontal surface, the paddle is at a lower horizontal elevation in the front than in the rear.

17. The sander of claim 14, wherein the sander housing comprises a rear and a front, which is opposite the rear;

wherein the sander housing comprises a first side and a second side opposite the first side, a line from the first side to the second side being perpendicular to a line from the front to the rear; and wherein, when the sander is placed on a flat horizontal surface, the paddle extends lower at the first and second sides than at a middle of the sander housing.

18. A sander comprising:

a housing extending from a proximal end to a distal end, the housing including a first convex upper surface having a surface area;

a power supply coupled to the distal end of the housing;

a motor disposed within the housing, the motor powered by the power supply and operable to drive an output member;

a switch in communication with the power supply and operable to selectively power the motor;

a switch actuation mechanism pivotably coupled to the proximal end of the housing via a hinge member and operable to actuate the switch, the switch actuation mechanism including a second convex upper surface having a surface area and a concave lower surface disposed adjacent to the first convex upper surface of the housing, such that the switch actuation mechanism is a substantially dome-shaped member and the concave lower surface of the switch actuation mechanism wraps around the first convex upper surface of the housing;

wherein, when the sander is placed on a flat horizontal surface, the motor is located entirely between the switch and the hinge member.

19. The sander of claim 18, wherein the power source is coupled to the housing at the distal end;

wherein, when the sander is placed on a flat horizontal surface, the switch actuation member is at a lower horizontal elevation at the proximal end than at the distal end.

* * * * *